US007905575B2

(12) United States Patent
Silverbrook

(10) Patent No.: US 7,905,575 B2
(45) Date of Patent: Mar. 15, 2011

(54) INKJET PRINTHEAD ASSEMBLY

(75) Inventor: Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 217 days.

(21) Appl. No.: 12/273,523

(22) Filed: Nov. 18, 2008

(65) Prior Publication Data

US 2009/0066760 A1 Mar. 12, 2009

Related U.S. Application Data

(63) Continuation of application No. 11/583,937, filed on Oct. 20, 2006, now Pat. No. 7,467,848, which is a continuation of application No. 11/144,803, filed on Jun. 6, 2005, now Pat. No. 7,140,718, which is a continuation of application No. 10/882,768, filed on Jul. 2, 2004, now Pat. No. 6,959,975, which is a continuation of application No. 10/713,089, filed on Nov. 17, 2003, now Pat. No. 6,799,836, which is a continuation of application No. 10/129,503, filed as application No. PCT/AU01/00239 on Mar. 6, 2001, now Pat. No. 6,676,245.

(30) Foreign Application Priority Data

Mar. 6, 2000 (AU) ..... PQ6058

(51) Int. Cl.
*B41J 2/06* (2006.01)

(52) U.S. Cl. ..... 347/55; 347/84

(58) Field of Classification Search ..... 347/84–85, 347/64–66, 55, 58–59, 42
See application file for complete search history.

(56) References Cited

U.S. PATENT DOCUMENTS

| | | | | |
|---|---|---|---|---|
| 5,506,608 | A | 4/1996 | Marler et al. | |
| 6,270,196 | B1 | 8/2001 | Uno et al. | |
| 6,799,836 | B2 | 10/2004 | Silverbrook | |
| 6,959,974 | B2 | 11/2005 | Silverbrook | |
| 6,959,975 | B2 | 11/2005 | Silverbrook | |
| 7,246,879 | B2 | 7/2007 | Silverbrook | |
| 7,284,825 | B2 | 10/2007 | Silverbrook | |
| 7,314,266 | B2 | 1/2008 | Silverbrook | |
| 7,467,848 | B2 * | 12/2008 | Silverbrook | 347/42 |

FOREIGN PATENT DOCUMENTS

| | | | |
|---|---|---|---|
| EP | 0841166 | A | 5/1998 |
| JP | 06-087213 | A | 3/1994 |
| JP | 6087213 | A | 3/1994 |
| JP | 10-157105 | A | 6/1998 |
| JP | 11-010861 | A | 1/1999 |
| JP | 2000-263768 | A | 9/2000 |

* cited by examiner

*Primary Examiner* — Lamson D Nguyen

(57) ABSTRACT

A printhead assembly is disclosed. The printhead assembly comprises a printhead formed from a silicon substrate, and a support member. The support member comprises a core element defining a plurality of ink reservoirs and a multilayer shell. Each ink reservoir is in fluid communication with the printhead. The multilayer shell is formed around at least part of the core element, and has an effective coefficient of thermal expansion which is comparable to that of silicon.

7 Claims, 1 Drawing Sheet

INKJET PRINTHEAD ASSEMBLY

CROSS REFERENCE TO RELATED APPLICATION

The present application is a continuation of U.S. application Ser. No. 11/583,937 filed on Oct. 20, 2006, which is a continuation of U.S. application Ser. No. 11/144,803 filed on Jun. 6, 2005 now issued as U.S. Pat. No. 7,140,718, which is a continuation of U.S. application Ser. No. 10/882,768 filed Jul. 2, 2004, now issued as U.S. Pat. No. 6,959,975 which is a continuation of U.S. application Ser. No. 10/713,089 filed Nov. 17, 2003, now issued as U.S. Pat. No. 6,799,836, which is a continuation of U.S. application Ser. No. 10/129,503 filed May 6, 2002, now issued as U.S. Pat. No. 6,676,245, which is a 371 of PCT/AU01/00239 filed on Mar. 6, 2001, all of which are herein incorporated by reference.

FIELD OF THE INVENTION

The present invention relates to printers, and in particular to digital inkjet printers.

CO-PENDING APPLICATIONS

Various methods, systems and apparatus relating to the present invention are disclosed in the following co-pending applications filed by the applicant or assignee of the present invention on 24 May 2000:

| | | |
|---|---|---|
| PCT/AU00/00578 | PCT/AU00/00579 | PCT/AU00/00581 |
| PCT/AU00/00580 | PCT/AU00/00582 | PCT/AU00/00587 |
| PCT/AU00/00588 | PCT/AU00/00589 | PCT/AU00/00583 |
| PCT/AU00/00593 | PCT/AU00/00590 | PCT/AU00/00591 |
| PCT/AU00/00592 | PCT/AU00/00584 | PCT/AU00/00585 |
| PCT/AU00/00586 | PCT/AU00/00594 | PCT/AU00/00595 |
| PCT/AU00/00596 | PCT/AU00/00597 | PCT/AU00/00598 |
| PCT/AU00/00516 | PCT/AU00/00517 | PCT/AU00/00511 |

Various methods, systems and apparatus relating to the present invention are disclosed in the following co-pending application, PCT/AU00/01445 filed by the applicant or assignee of the present invention on 27 Nov. 2000. The disclosures of these co-pending applications are incorporated herein by cross-reference. Also incorporated by cross-reference, is the disclosure of a co-filed PCT application, PCT/AU01/00238 (deriving priority from Australian Provisional Patent Application No. PQ6059).

BACKGROUND OF THE INVENTION

Recently, inkjet printers have been developed which use printheads manufactured by micro-electro mechanical system(s) (MEMS) techniques. Such printheads have arrays of microscopic ink ejector nozzles formed in a silicon chip using MEMS manufacturing techniques.

Printheads of this type are well suited for use in pagewidth printers. Pagewidth printers have stationary printheads that extend the width of the page to increase printing speeds. Pagewidth printheads do not traverse back and forth across the page like conventional inkjet printheads, which allows the paper to be fed past the printhead more quickly.

To reduce production and operating costs, the printheads are made up of separate printhead modules mounted adjacent each other on a support beam in the printer. To ensure that there are no gaps or overlaps in the printing produced by adjacent printhead modules it is necessary to accurately align the modules after they have been mounted to the support beam. Once aligned, the printing from each module precisely abuts the printing from adjacent modules.

Unfortunately, the alignment of the printhead modules at ambient temperature will change when the support beam expands as it heats up during printhead operation. Furthermore, if the printhead modules are accurately aligned when the support beam is at the equilibrium operating temperature, there may be unacceptable misalignments in any printing before the beam has reached the operating temperature. Even if the printhead is not modularized, thereby making the alignment problem irrelevant, the support beam and printhead may bow because of different thermal expansion characteristics. Bowing across the lateral dimension of the support beam does little to affect the operation of the printhead. However, as the length of the beam is its major dimension, longitudinal bowing is more significant and can affect print quality.

SUMMARY OF THE INVENTION

According to an aspect of the present invention there is provided a printhead assembly comprising:

- a printhead formed from a silicon substrate; and
- a support member comprising:
  - a core element defining a plurality of ink reservoirs, each ink reservoir being in fluid communication with the printhead; and
  - a multilayer shell formed around at least part of the core element, the multilayer shell having an effective coefficient of thermal expansion which is comparable to that of silicon.

Other aspects are also disclosed.

In some embodiments, the printhead is a plurality of printhead modules positioned end to end along the beam.

BRIEF DESCRIPTION OF THE DRAWINGS

A preferred embodiment of the invention will now be described, by way of example only, with reference to the accompanying drawing in which.

DETAILED DESCRIPTION OF THE PREFERRED EMBODIMENTS

Figure 1:
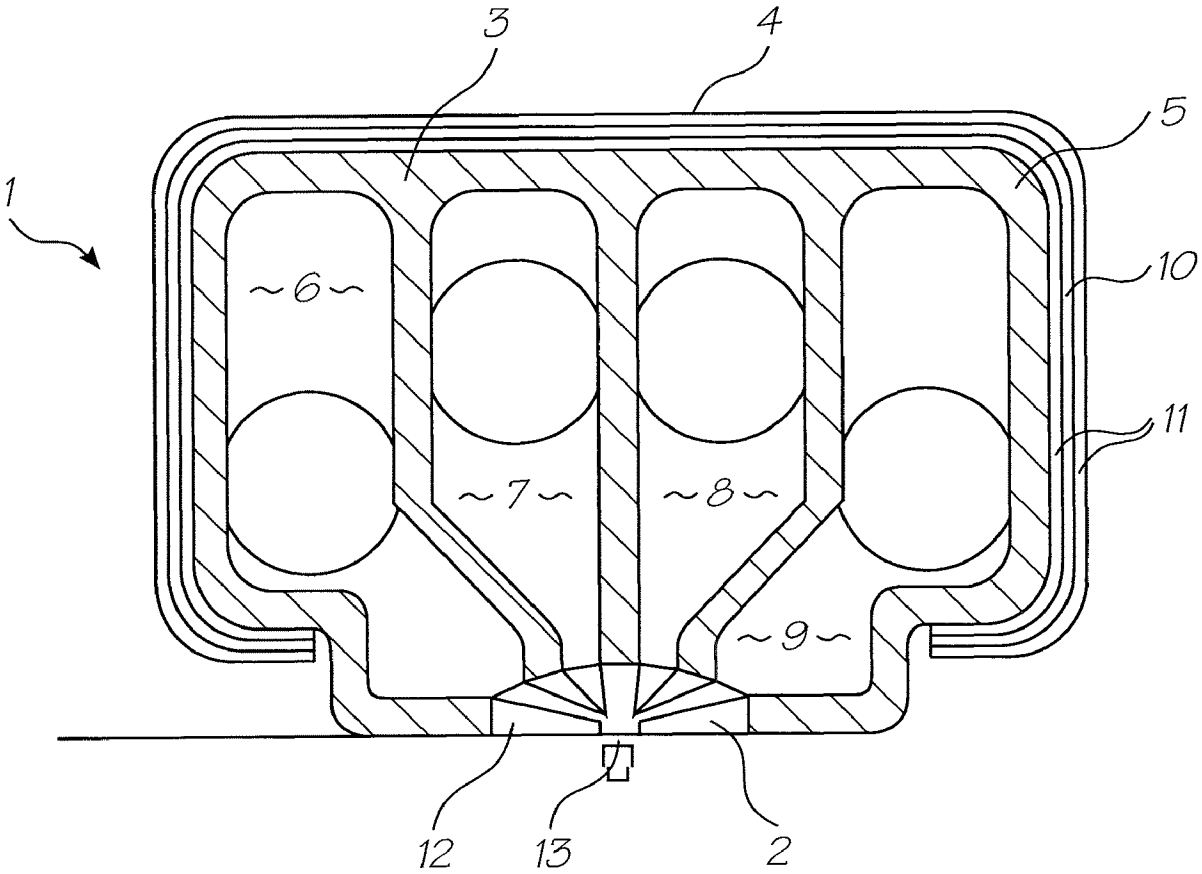
FIG. 1 is a schematic cross section of a printhead assembly according to the present invention.

Referring to the FIGURE, the printhead assembly 1 includes a printhead 2 mounted to a support member 3. The support member 3 has an outer shell 4 and a core element 5 defining four separate ink reservoirs 6, 7, 8 and 9. The outer shell 4 is a hot rolled trilayer laminate of two different metals. The first metal layer 10 is sandwiched between layers of the second metal 11. The metals forming the trilayer shell are selected such that the effective coefficient of thermal expansion of the shell as a whole is substantially equal to that of silicon even though the coefficients of the core and the individual metals may significantly differ from that of silicon. Provided that the core or one of the metals has a coefficient of thermal expansion greater than that of silicon, and another has a coefficient less than that of silicon, the effective coefficient can be made to match that of silicon by using different layer thicknesses in the laminate.

Typically, the outer layers 11 are made of invar which has a coefficient of thermal expansion of $1.3\times10^{-6}$ m/° C. The coefficient of thermal expansion of silicon is about $2.5\times10^{-6}$ m/° C. and therefore the central layer must have a coefficient greater than this to give the support beam an overall effective coefficient substantially the same as silicon.

The printhead 2 includes a micro moulding 12 that is bonded to the core element 5. A silicon printhead chip 13 constructed using MEMS techniques provides the ink nozzles, chambers and actuators.

As the effective coefficient of thermal expansion of the support beam is substantially equal to that of the silicon printhead chip, the distortions in the printhead assembly will be minimized as it heats up to operational temperature. Accordingly, if the assembly includes a plurality of aligned printhead modules, the alignment between modules will not change significantly. Furthermore, as the laminated structure of the outer shell is symmetrical in the sense that different metals are symmetrically disposed around a central layer, there is no tendency of the shell to bow because of greater expansion or contraction of any one metal in the laminar structure. Of course, a non-symmetrical laminar structure could also be prevented from bowing by careful design of the lateral cross section of the shell.

The invention has been described herein by way of example only. Skilled workers in this field will readily recognise that the invention may be embodied in many other forms.

The invention claimed is:

1. A printhead assembly comprising:

a printhead formed from a silicon substrate; and a support member comprising:

a core element defining a plurality of ink reservoirs, each ink reservoir being in fluid communication with the printhead; and a multilayer shell formed around at least part of the core element, the multilayer shell having an effective coefficient of thermal expansion which is comparable to that of silicon.

2. A printhead assembly as claimed in claim 1, wherein the multilayer shell is formed from a plurality of layers of metals, each of the layers having a coefficient of thermal expansion which is different to that of silicon.

3. A printhead assembly as claimed in claim 1, wherein the printhead comprises a moulding bonded to the core element and a silicon printhead integrated circuit, the moulding defining a plurality of ink passages for passing ink from the ink reservoirs to the printhead integrated circuit.

4. A printhead assembly as claimed in claim 1, wherein the multilayer shell comprises a triplet of metal layers, one of the layers having a first coefficient of thermal expansion and is located between a pair of layers each having a second coefficient of thermal expansion.

5. A printhead assembly as claimed in claim 4, wherein the first coefficient of thermal expansion is greater than the second coefficient of thermal expansion.

6. A printhead assembly as claimed in claim 5, wherein the second coefficient of thermal expansion is about $1.3\times10^{-6}$ m/° C.

7. A printhead assembly as claimed in claim 5, wherein the first coefficient of thermal expansion exceeds $2.5\times10^{-6}$ m/° C.

* * * * *